US011486283B2

(12) United States Patent
Cloutier

(10) Patent No.: US 11,486,283 B2
(45) Date of Patent: Nov. 1, 2022

(54) DUAL FUNCTION EXHAUST SYSTEM ATTACHMENT

(71) Applicant: Jason Joseph Cloutier, Thunder Bay (CA)

(72) Inventor: Jason Joseph Cloutier, Thunder Bay (CA)

(73) Assignee: Jason Joseph Cloutier, Thunder Bay (CA)

( * ) Notice: Subject to any disclaimer, the term of this patent is extended or adjusted under 35 U.S.C. 154(b) by 78 days.

(21) Appl. No.: 17/218,524

(22) Filed: Mar. 31, 2021

(65) Prior Publication Data

US 2022/0316371 A1 Oct. 6, 2022

(51) Int. Cl.
*F01N 1/08* (2006.01)

(52) U.S. Cl.
CPC ..... *F01N 1/083* (2013.01); *F01N 2410/10* (2013.01); *F01N 2470/14* (2013.01)

(58) Field of Classification Search
CPC ..... F01N 1/166; F01N 3/005; F01N 13/087; F01N 2260/06; F01N 2260/14; F01N 2410/10; F01N 2410/14; F01N 2470/14
See application file for complete search history.

(56) References Cited

U.S. PATENT DOCUMENTS 790,248 A * 5/1905 Blomstrom ..... F01N 1/166 181/236
3,620,330 A 11/1971 Hall
3,749,199 A 7/1973 Weber
4,226,173 A 10/1980 Khosropour
4,354,573 A 10/1982 Tabata et al.
4,533,015 A 8/1985 Kojima
4,779,705 A * 10/1988 Verdin ..... F01N 13/087 181/240

(Continued)

FOREIGN PATENT DOCUMENTS

DE 102010008742 A1 * 8/2011 ..... F01N 1/08
FR 619949 A 4/1927

(Continued)

OTHER PUBLICATIONS

Machine translation of KR-100402686-B1, accessed Aug. 12, 2022. (Year: 2022).*

(Continued)

*Primary Examiner* — Jonathan R Matthias
(74) *Attorney, Agent, or Firm* — Stratford Group Ltd.

(57) ABSTRACT

The dual function exhaust system attachment, which is preferably used with an all-terrain vehicle, includes a muffler, a silencing cap, and a sound-enhancing plug. In a quiet configuration, the silencing cap is mounted to conceal a primary outlet of the muffler. In a loud configuration, the sound-enhancing plug is mounted to conceal a secondary outlet of the muffler. A set of screw threads or sealing mechanism may be used to mount the silencing cap and the sound-enhancing plug. A primary perforated barrier, a solid barrier, at least one secondary perforated barrier, and a pipe section are positioned within a hollow structural body of the muffler to guide the exhaust gas flow from an inlet of the muffler to the primary outlet or the secondary outlet.

18 Claims, 11 Drawing Sheets

(56) References Cited

U.S. PATENT DOCUMENTS

| | | | | |
|---|---|---|---|---|
| 4,842,096 | A * | 6/1989 | Fujitsubo | F01N 1/24 181/254 |
| 5,959,263 | A * | 9/1999 | Foltz, Jr. | F01N 1/084 181/254 |
| 6,047,739 | A | 4/2000 | Nixon | |
| 7,293,629 | B2 | 11/2007 | Nasuno et al. | |
| 7,350,619 | B2 | 4/2008 | Williams | |
| 7,527,126 | B2 | 5/2009 | Kuroda et al. | |
| 2004/0084240 | A1* | 5/2004 | Gearing | F01N 1/08 180/309 |
| 2006/0243822 | A1* | 11/2006 | Maslar | F01N 1/165 239/265.35 |
| 2008/0121458 | A1 | 5/2008 | Sturgis | |
| 2009/0229913 | A1 | 9/2009 | Tonietto et al. | |
| 2010/0051379 | A1 | 3/2010 | Graves | |
| 2020/0063621 | A1* | 2/2020 | Wang | F01N 13/1838 |

FOREIGN PATENT DOCUMENTS

| | | | | |
|---|---|---|---|---|
| GB | 2382377 | A * | 5/2003 | F01N 1/084 |
| KR | 100402686 | B1 * | 10/2003 | |
| WO | WO-2006017884 | A1 * | 2/2006 | A01G 1/125 |
| WO | 2012078080 | A1 | 6/2012 | |

OTHER PUBLICATIONS

Machine translation of DE-102010008742-A1, accessed Aug. 12, 2022 (Year: 2022).*

International Search Report dated May 26, 2022, in respect of corresponding PCT International Patent Application No. PCT/CA2022/050421.

* cited by examiner

DUAL FUNCTION EXHAUST SYSTEM ATTACHMENT

BACKGROUND

All-terrain vehicles (ATVs) are used for a variety of activities. For example, ATVs can be used for industrial purposes such as land management, mineral exploration, search and rescue, and fire control. ATVs can also be used for recreational activities such as hunting, camping, and off-road racing. Based on the activity the ATV is used for, the user may require a different configuration for the ATV. For example, if the ATV is used for hunting, the user may prefer to have less sound emitted from the exhaust pipe. In contrast, if the ATV is used for off-road racing, the user may prefer the ATV to be louder during operation.

U.S. Pat. No. 4,226,173A discloses a protective cap for an exhaust pipe. The prior art describes a U-shaped clamp and an arm, wherein the U-shaped clamp is used to attach the protective cap adjacent an outer end of the exhaust pipe. The arm is connected to a lid, wherein the lid encloses an outer end of the exhaust pipe. A pivoting mechanism is used to change the lid from a closed configuration to an open configuration. More specifically, the exhaust gas passing through the exhaust pipe changes the lid from a closed configuration to an open configuration. This document describes a device having a flap that can open and close due to the exhaust gas, but does not describe a device having two modes of operation.

US20100051379A1 discloses a system and method to improve performance of an internal combustion engine. The system is primarily used to attenuate the sound emitted from an exhaust pipe. The prior art describes utilizing a supplementary pipe that is operatively coupled to the exhaust pipe through calibrated orifices on the exhaust pipe. This document does not describe having two different modes of operation nor a process of enhancing the sound emitted from the exhaust pipe.

U.S. Pat. No. 6,047,739A discloses a cover to conceal an opening of a vertical exhaust pipe. The cover of the prior art is primarily used to prevent debris from entering the vertical exhaust pipe. The prior art further describes using a cylindrical sleeve to be positioned over the exhaust pipe. The cover is mounted onto and removed from the exhaust pipe with a telescopic pole, wherein the telescopic pole allows the tractor-trailer driver to conveniently install or remove the cover. This document does not describe a quiet mode and a sports mode, and is intended to be used with vertical exhaust pipes to prevent debris from entering the exhaust pipe.

U.S. Pat. No. 7,293,629B2 discloses an exhaust apparatus for a small-sized engine that includes an exhaust pipe and a muffler. The muffler utilizes a filter formed with metal fibers to reduce the overall sound emitted from the exhaust pipe. Moreover, the muffler of the prior art further includes a wire net covering to contain any sparks generated. This document does not describe a system to enhance the sound and only describes being used with a single outlet.

WO2012078080A1 discloses an exhaust pipe assembly for a vehicle to improve noise reduction and improve noise abatement efficiency. The exhaust pipe assembly is acoustically coupled to an engine noise shield to reduce airborne and structural noise emission. In a different aspect, the exhaust pipe assembly provides heat protection as well. This document describes a system to reduce the overall noise from the engine.

FR619949A discloses a valve that reduces the sound emitted from an exhaust pipe and improves exhaust gas flow.

This document describes the use of a cap to alter the sound emitted from the exhaust pipe, but does not describe having different modes.

US20080121458A1 discloses an exhaust extension that alters the sound emitted from the exiting exhaust gas. The exhaust extension primarily utilizes a tapered cone and a set of slits, wherein the dimensions of the slits can be varied to obtain different output sounds. This document focuses on achieving harmonic tones similar to a wind instrument. However, the document does not describe reducing or enhancing the overall sound.

U.S. Pat. No. 4,354,573A discloses a tail cap of a silencer for a motorcycle to change the external appearance and design without changing the silencer body. The tail cap, which can be mounted and dismounted according to user preference, comprises an inner cylinder and an outer cylinder. A plurality of spacers extends from the inner cylinder to the outer cylinder. This document describes a device used for appearance.

U.S. Pat. No. 4,533,015A discloses a sound arresting device. In addition to mitigating sound, the device of the prior art can also be used to remove foreign particles from the exhaust pipe. To obtain the preferred results, the prior art includes a plurality of blades within a passage pipe. The overall orientation of each of the blades creates a set of channels for air flow. An acoustic wave passing through a first channel interferes with a different acoustic wave passing through a second channel to cancel noise. This document describes using blades and channels to reduce sound and does not describe a process of amplifying the overall sound.

U.S. Pat. No. 7,350,619B2 discloses an exhaust duct comprising a replaceable acoustic liner, wherein the acoustic liner is made of acoustically permeable material. The exhaust duct described in the prior art is intended to be used in an aircraft. This document describes a sound mitigating device but does not describe having two different modes.

All documents cited here are incorporated by reference.

None of the above cited documents, alone or in combination satisfy the need for an exhaust system attachment that enables the user to have two different riding modes.

BRIEF SUMMARY

It is an object of the invention to provide a dual function exhaust attachment.

In accordance with an aspect of the invention there is provided a dual function exhaust system attachment, comprising: a muffler having a hollow essentially cylindrical structural body and first and second ends; an inlet at the first end of the structural body; a primary outlet, having a primary inner diameter, the primary outlet positioned at the second end of the structural body extending outwards from the hollow structural body; a secondary outlet, having a secondary inner diameter, the secondary outlet extending outwards from the hollow structural body; a silencing cap that is removably attached to the primary outlet; and a sound-enhancing plug that is detachably mounted onto the secondary outlet, wherein the primary inner diameter of the primary outlet is greater than the secondary inner diameter of the secondary outlet.

In accordance with another aspect of the invention there is provided the dual function exhaust system attachment as described above, wherein the muffler further comprising: a primary perforated barrier positioned adjacent the inlet; at least one solid barrier; at least one secondary perforated barrier being positioned adjacent the primary outlet; an insulation layer layered along an inner surface of the hollow structural body; and a pipe section traversing through the at least one secondary perforated barrier and the at least one solid barrier, the pipe section is concentrically aligned with the primary outlet and the pipe section being in fluid communication with the primary outlet, wherein the primary perforated barrier, the at least one solid barrier, and the at least one secondary perforated barrier are positioned adjacent and in parallel to each other within the hollow structural body.

In accordance with an additional aspect of the invention there is provided the dual function exhaust system as described above, wherein the dual function exhaust system attachment is in a quiet configuration, wherein the silencing cap is removably attached to the primary outlet with a first attachment mechanism; the first attachment mechanism comprises a first set of internal threads, wherein the first set of internal threads is distributed along an inner surface of the silencing cap; the first attachment mechanism comprises a first set of external threads, wherein the first set of external threads is distributed along an outer surface of the primary outlet; and the first set of internal threads being threadedly engaged to the first set of external threads.

The advantages and features of the present invention will become better understood with reference to the following more detailed description and claims taken in conjunction with the accompanying drawings in which like elements are identified with like symbols.

To easily identify the discussion of any particular element or act, the most significant digit or digits in a reference number refer to the figure number in which that element is first introduced.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
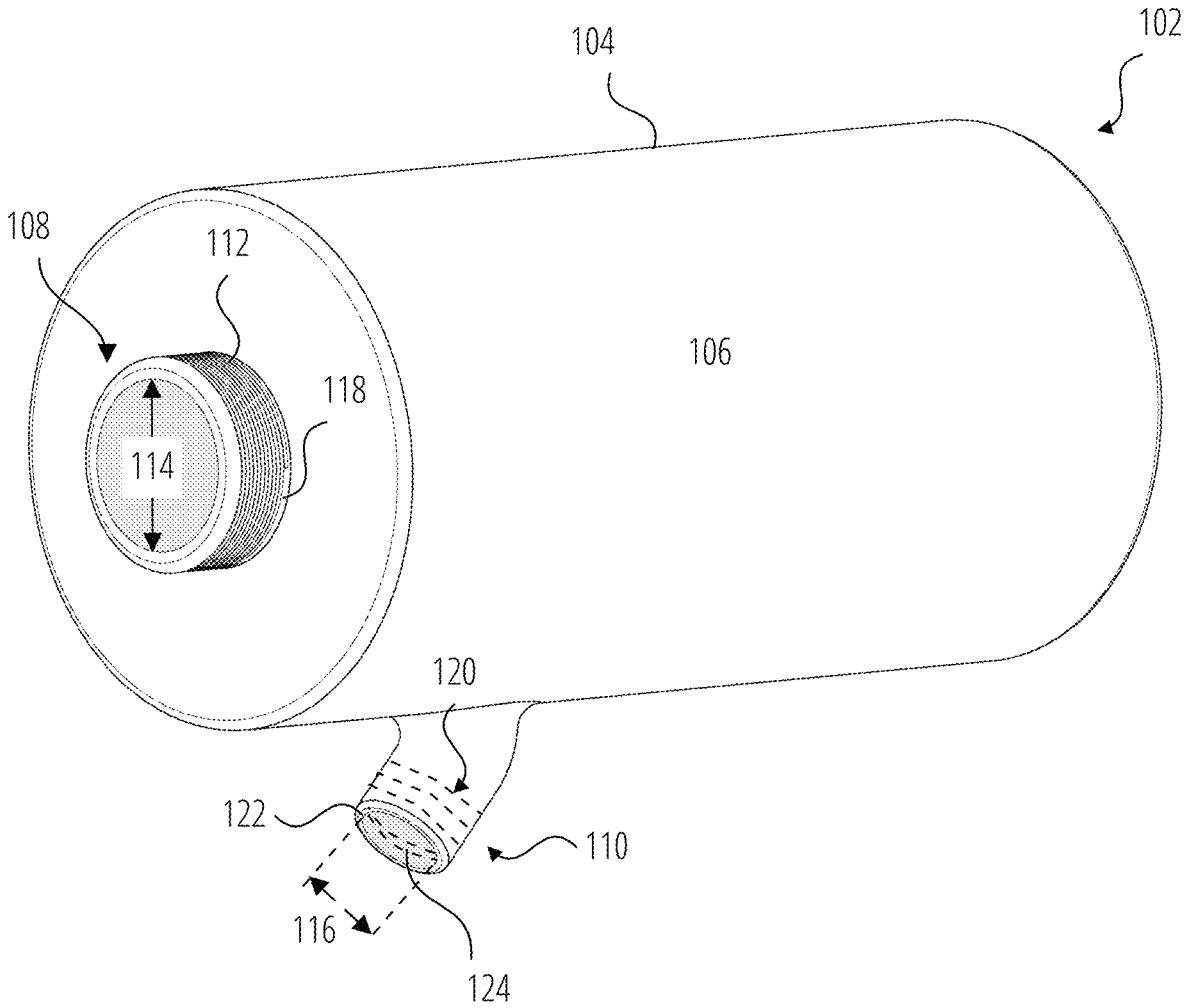
FIG. 1 is a perspective view of a muffler, wherein a hollow structural body, a primary outlet, and a secondary outlet are illustrated.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

The present disclosure describes an exhaust system attachment that may be used to obtain two distinct configurations. In contrast to existing exhaust systems that mainly focus on mitigating the sound emitted from the engine, the present disclosure provides the user with two exhaust configurations. In particular, the system of the present disclosure allows the user to have a quiet configuration and a loud configuration. The quiet configuration may be used for activities such as hunting and gardening. The loud configuration may be used for activities such as off-road racing.

The exhaust system attachment, which is preferably used with an all-terrain vehicle (ATV), includes a muffler, a silencing cap, and a sound-enhancing plug. In a quiet configuration, the silencing cap conceals a primary outlet of the muffler to reduce the overall exhaust sound. In a loud configuration, the sound-enhancing plug conceals a secondary outlet of the muffler to improve the sound emitted and increase performance of the ATV. By utilizing the dual function exhaust system attachment of the present disclosure, the need to make exhaust system modifications for each configuration may be mitigated.

The embodiments of the invention as described herein relate to a dual function exhaust system attachment that may be used to obtain different exhaust configurations in a motor vehicle. By utilizing the exhaust system attachment of the present disclosure, the user may switch between different exhaust system configurations without performing extensive modifications. Since a single system is used for multiple configurations, the exhaust system attachment of the present disclosure may save time and be cost effective. To enable a loud configuration and a quiet configuration, the exhaust system attachment of the present disclosure comprises a muffler, a silencing cap, and a sound-enhancing plug, wherein the muffler is connected to a motor vehicle the dual function exhaust system attachment is used on. Preferably, the muffler is connected horizontally. However, in an embodiment of the present disclosure the muffler may also be connected vertically. The silencing cap and the sound-enhancing plug are used interchangeably to obtain the different configurations. In particular, to obtain the quiet configuration, the silencing cap is removably attached to a primary outlet of the muffler. To obtain the loud configuration, the sound-enhancing plug is detachably mounted onto a secondary outlet of the muffler. Preferably, the dual function exhaust system attachment of the present disclosure is used with an all-terrain vehicle (ATV). However, the dual function exhaust system may also be used with utility terrain vehicles (UTVs), off-road bikes, or any other comparable motor vehicle in other embodiments of the present disclosure. For example, embodiments of the present disclosure may also be used with standard motorbikes, scrambler motorbikes, sport bikes, touring motorbikes, cruiser motorbikes, adventure motorbikes, dual-sport motorbikes, and snowmobiles.

FIG. 1 is a perspective view of a muffler 102 of the dual function exhaust system attachment described in the present disclosure. As seen in FIG. 1, the muffler 102 comprises a hollow structural body 104, a primary outlet 108, and a secondary outlet 110. When the dual function exhaust system attachment is connected to a motor vehicle, exhaust emissions initiated at the engine exit through the primary outlet 108, the secondary outlet 110, or both the primary outlet 108 and the secondary outlet 110. As illustrated in FIG. 1, for the exhaust gas to exit the muffler 102, the primary outlet 108 and the secondary outlet 110 extend outward from the hollow structural body 104. In a preferred embodiment, the secondary outlet 110 extends outward from a lateral surface 106 of the hollow structural body 104. Furthermore, to enable different exhaust configurations, an inner diameter 114 of the primary outlet 108 is greater than an inner diameter 116 of the secondary outlet 110. In other embodiments of the present disclosure, a diameter difference between the inner diameter 114 of the primary outlet 108 and the inner diameter 116 of the secondary outlet 110 may be adjusted to vary the loud configuration and the quiet configuration. For example, if the inner diameter 114 is 8 millimeters (mm) and the inner diameter 116 is 4 mm, the diameter difference is 4 mm. However, in a different embodiment, the inner diameter 114 and the inner diameter 116 can be varied such that the diameter difference can be, but is not limited to, 2 mm, 3 mm, and 5 mm.

Figure 2:
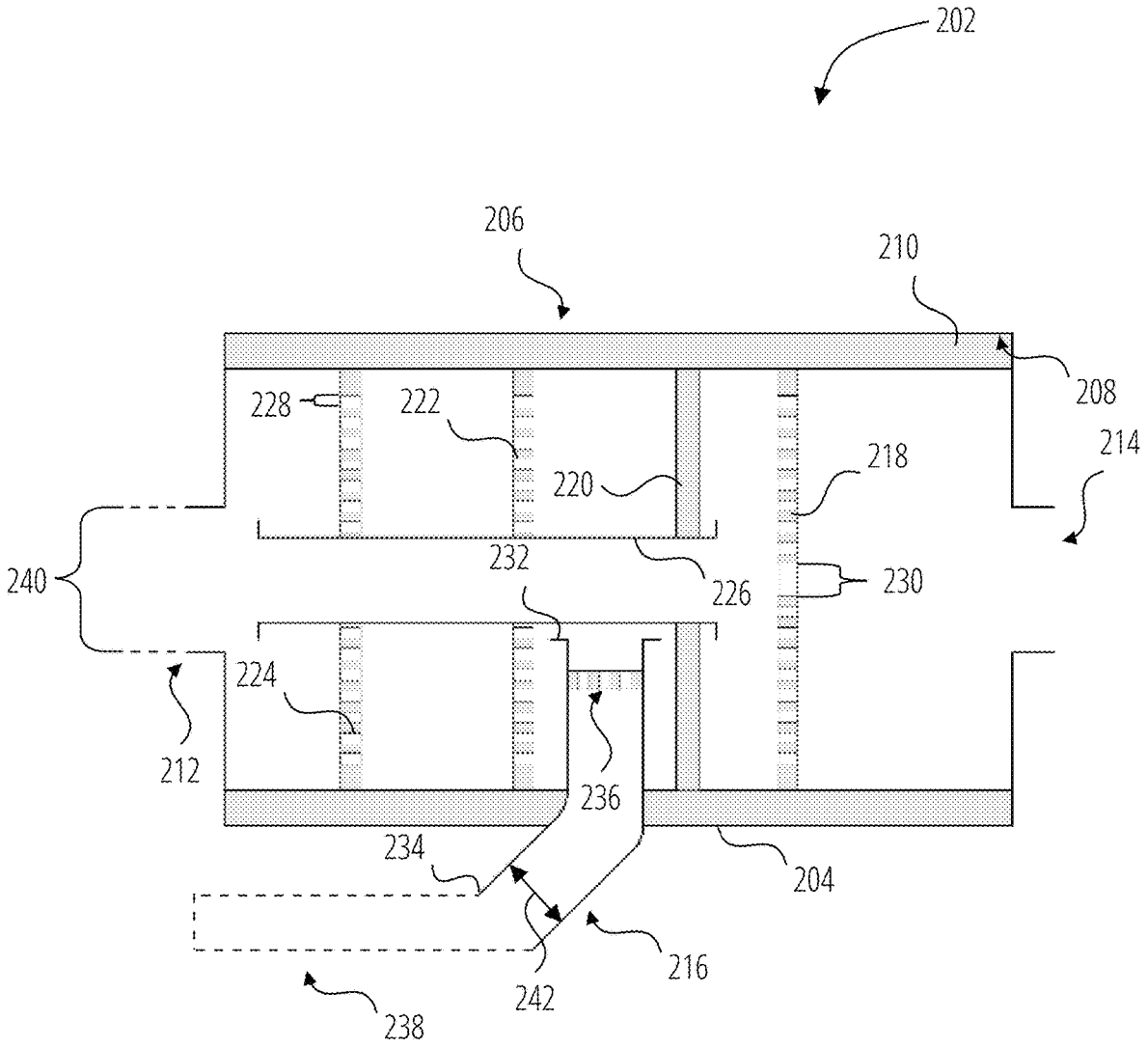
FIG. 2 is a cross-sectional side view of the muffler, wherein a primary perforated barrier, at least one solid barrier, at least one secondary perforated barrier, and a pipe section are illustrated within the hollow structural body.

FIG. 2 is a cross-sectional side view of the muffler 202, wherein the muffler 202 further comprises an inlet 214 that is terminally connected to the hollow structural body 206. As further illustrated in FIG. 2, the primary outlet 212 is terminally connected to the hollow structural body 206 opposite the inlet 214. The positioning of the inlet 214, the primary outlet 212, and the secondary outlet 216 enables the exhaust gas entering the muffler 202 through the inlet 214 to exit through the primary outlet 212 and/or the secondary outlet 216.

Figure 3:
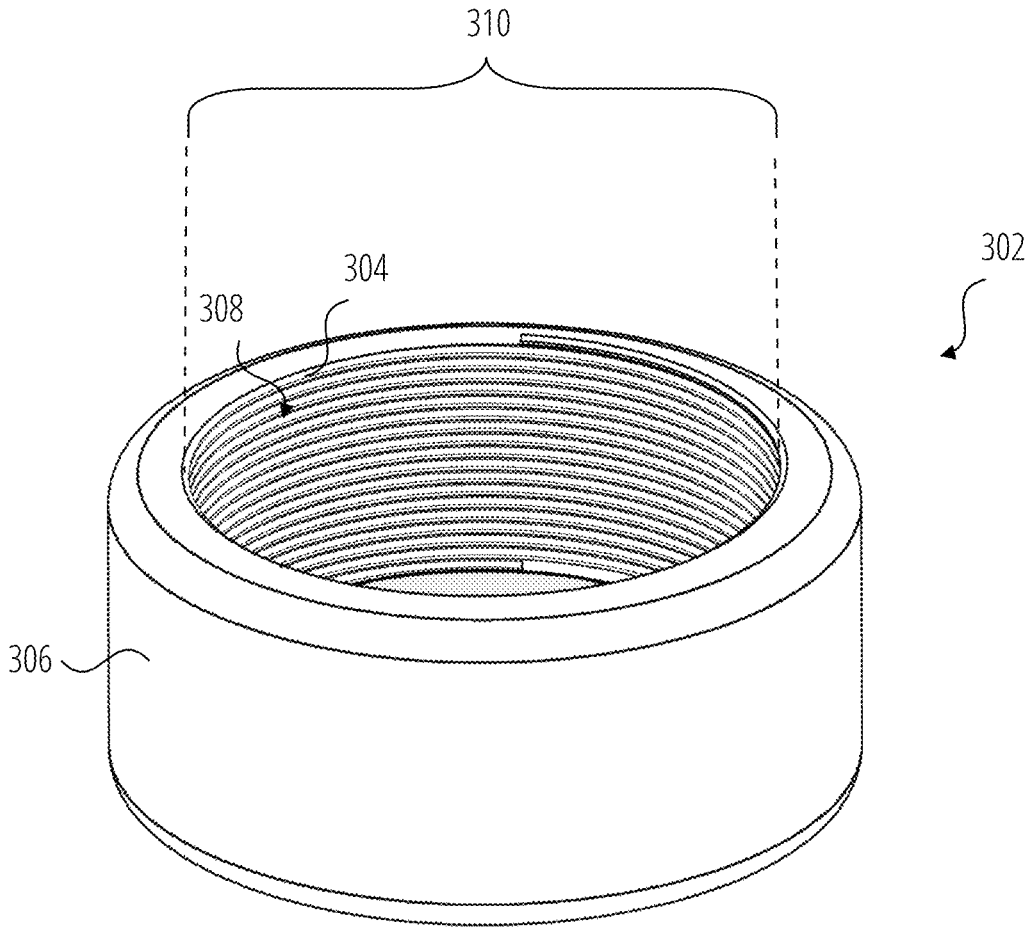
FIG. 3 is a perspective view of a silencing cap, wherein a first set of internal threads used to attach the silencing cap to the muffler and an outer surface of the silencing cap are illustrated.

FIG. 3 is a perspective view of the silencing cap 302 used in a preferred embodiment of the present disclosure. The silencing cap 302 is used to conceal the primary outlet 212 of FIG. 2 so that the overall sound emitted from the motor vehicle is mitigated. More specifically, when the silencing cap 302 of FIG. 3 conceals the primary outlet 212 of FIG. 2, the exhaust gas exits only through the secondary outlet 216 shown in FIG. 2. As seen in FIG. 1, since the inner diameter 116 of the secondary outlet 110 is lesser than the inner diameter 114 of the primary outlet 108, the overall sound emitted from the motor vehicle is mitigated and the quiet configuration is enabled. In a preferred embodiment, the quiet configuration may be used for activities such as hunting or camping.

Figure 4:
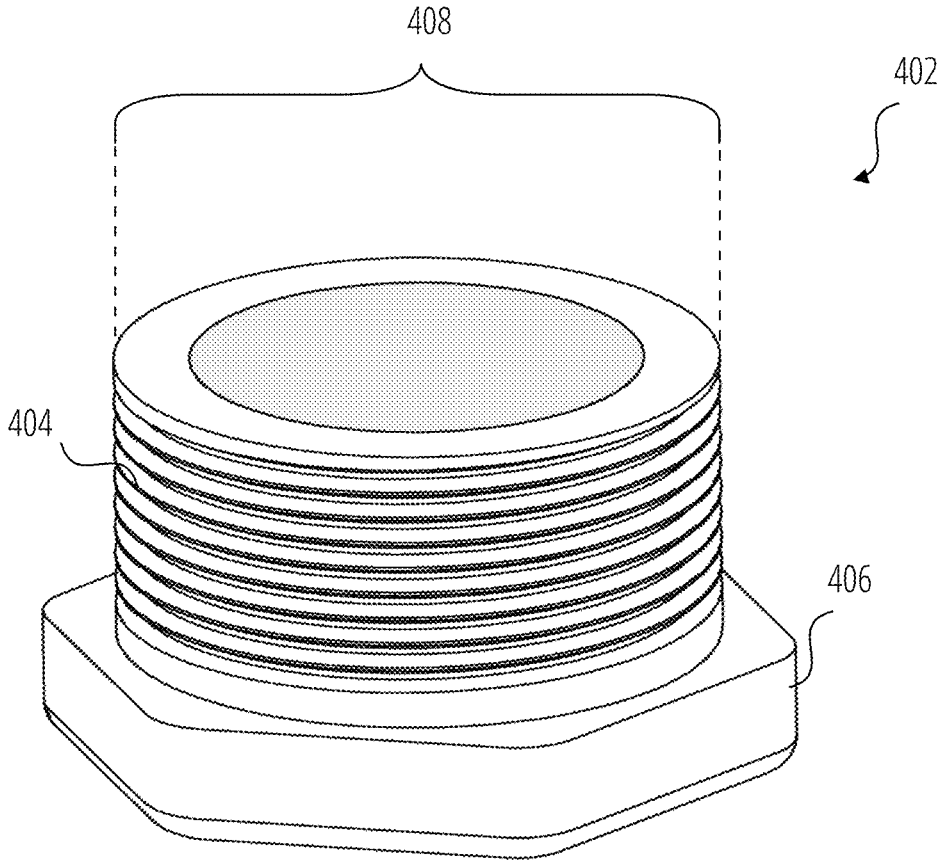
FIG. 4 is a perspective view of a sound-enhancing plug, wherein a second set of external threads used to mount the sound-enhancing plug to the muffler and an outer surface of the sound-enhancing plug are illustrated.

FIG. 4 is a perspective view of the sound-enhancing plug 402 used in a preferred embodiment of the present disclosure. The sound-enhancing plug 402 is used to conceal the secondary outlet 216 shown in FIG. 2 so that the overall sound emitted from the motor vehicle is enhanced. More specifically, when the sound-enhancing plug 402 of FIG. 4 conceals the secondary outlet 216 of FIG. 2, the exhaust gas exits only through the primary outlet 212 shown in FIG. 2. As seen in FIG. 1, since the inner diameter 114 of the primary outlet 108 is greater than the inner diameter 116 of the secondary outlet 110, the overall sound emitted from the motor vehicle is enhanced/amplified enabling the loud configuration. In a preferred embodiment, the loud configuration may be used for activities such as off-road racing.

Figure 5:
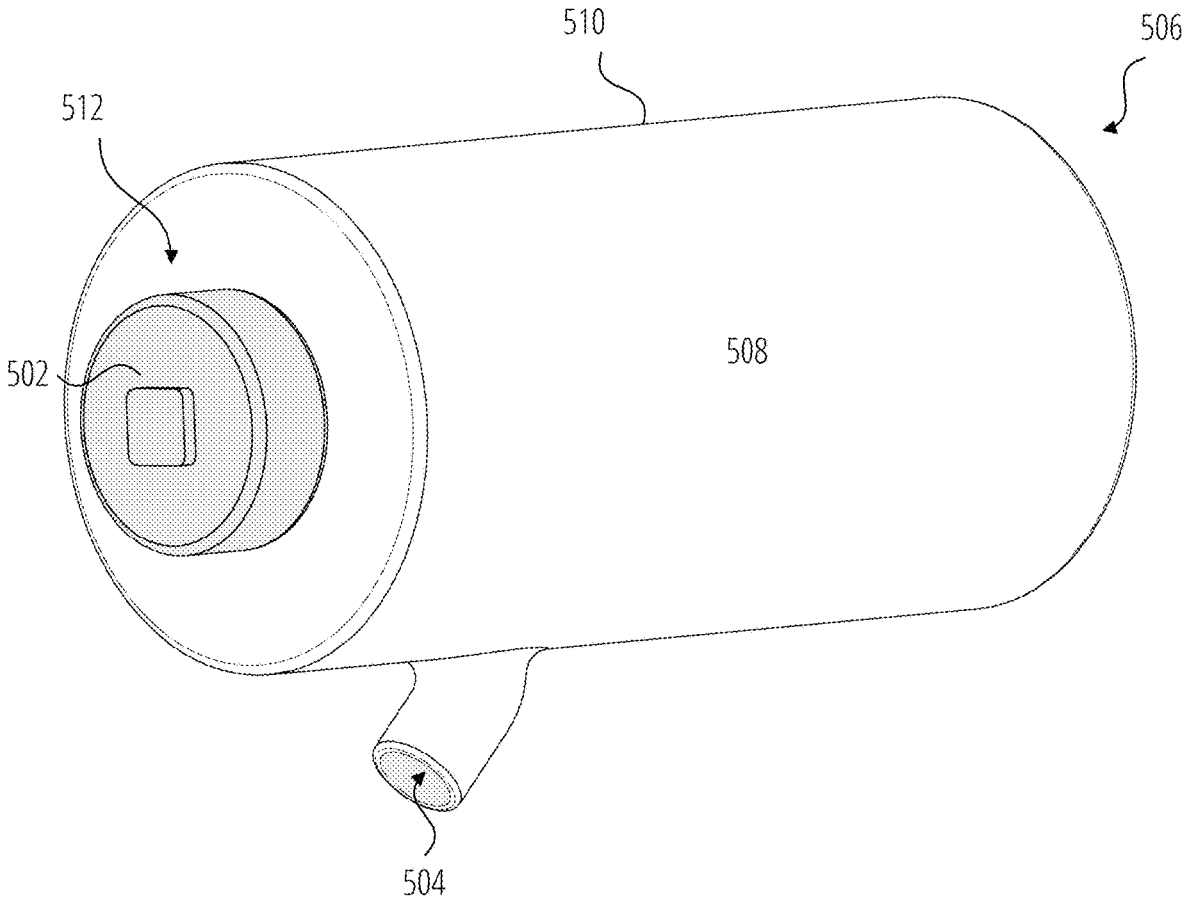
FIG. 5 is a perspective view of the muffler, wherein the dual function exhaust system attachment is in a quiet configuration with the silencing cap mounted to conceal the primary outlet.

FIG. 5 is a perspective view of the dual function exhaust system of the present disclosure in the quiet configuration. As seen in FIG. 5, the silencing cap 502 conceals the primary outlet 108 of FIG. 1 such that the exhaust gas exits only through the secondary outlet 504.

In a preferred embodiment of the present disclosure, the silencing cap 502 is removably attached to the primary outlet 108 of FIG. 1 using a first attachment mechanism 512 as seen in FIG. 5. In a preferred embodiment, the first attachment mechanism 512 comprises a first set of external threads 112, as seen in FIG. 1, and a first set of internal threads 308 as seen in FIG. 3. In further reference to FIG. 1, the first set of external threads 112 is distributed along an outer surface 118 of the primary outlet 108. In reference to FIG. 3, the first set of internal threads 308 is distributed along an inner surface 304 of the silencing cap 302.

When the dual function exhaust system attachment of the of the present disclosure is in the quiet configuration, the first set of internal threads 308 shown in FIG. 3 is threadedly engaged with the first set of external threads 112 shown in FIG. 1 to removably attach the silencing cap 302 of FIG. 3 to conceal the primary outlet 108 of FIG. 1. To maintain a tight seal between the silencing cap 302 of FIG. 3 and the primary outlet 108 of FIG. 1, an inner diameter 310 of the silencing cap 302, seen in FIG. 3, equals an outer diameter 240 of the primary outlet 212 shown in FIG. 2.

Figure 9:
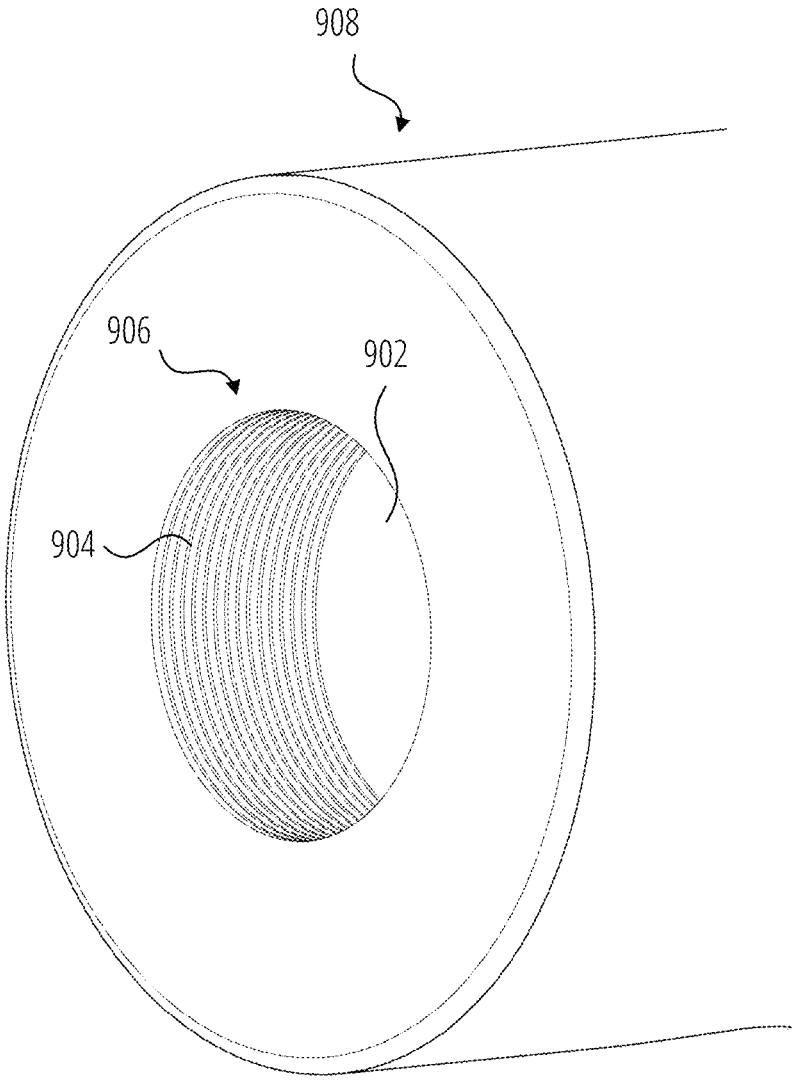
FIG. 9 is a perspective view of the primary outlet, wherein a set of engagement threads is distributed along an internal surface.
Figure 10:
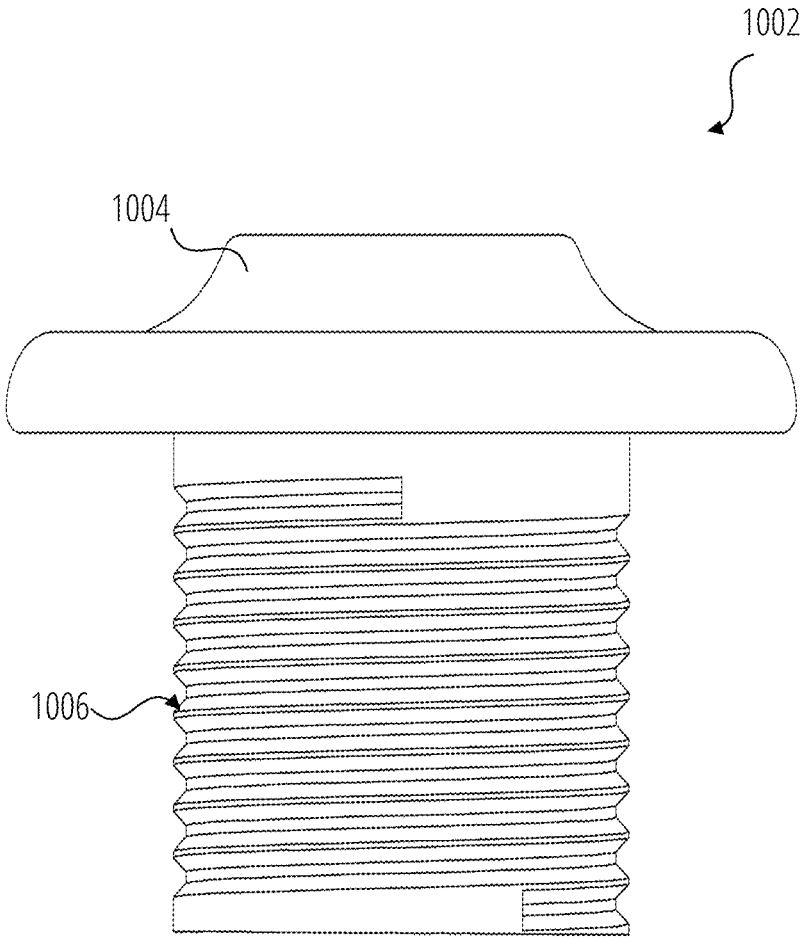
FIG. 10 is a side view of the silencing cap, wherein a set of engagement threads is externally distributed.

In a different embodiment, as seen in FIG. 9, a set of engagement threads 904 may be distributed along an inner surface 902 of the primary outlet 906. Accordingly, as seen in FIG. 10, a set of engagement threads 1006 may be distributed externally on the silencing cap 1002 to correspond with the primary outlet 906 of FIG. 9. In the quiet configuration, the set of the set of engagement threads 1006 of FIG. 1 will be threadedly engaged with the set of engagement threads 904 of FIG. 9 to conceal the primary outlet 906 seen in FIG. 9.

Even though the silencing cap 302 of FIG. 3 is threadedly engaged to the primary outlet 108 of FIG. 1 in a preferred embodiment, other attachment mechanisms may be used in embodiments of the present disclosure. For example, the silencing cap 302 of FIG. 3 may be removably attached to the primary outlet 108 of FIG. 1 via a flush mount pop-up attachment mechanism. In another embodiment, the silencing cap 302 of FIG. 3 may be attached to the primary outlet 108 of FIG. 1 using a tool that can be, but is not limited to, a hex key. In another embodiment, the silencing cap 302 can be attached to the primary outlet 108 via an attachment mechanism that can be, but is not limited to, magnetic coupling, a trap door attachment mechanism, sliding lock latch mechanism, or a turn lock mechanism.

Figure 6:
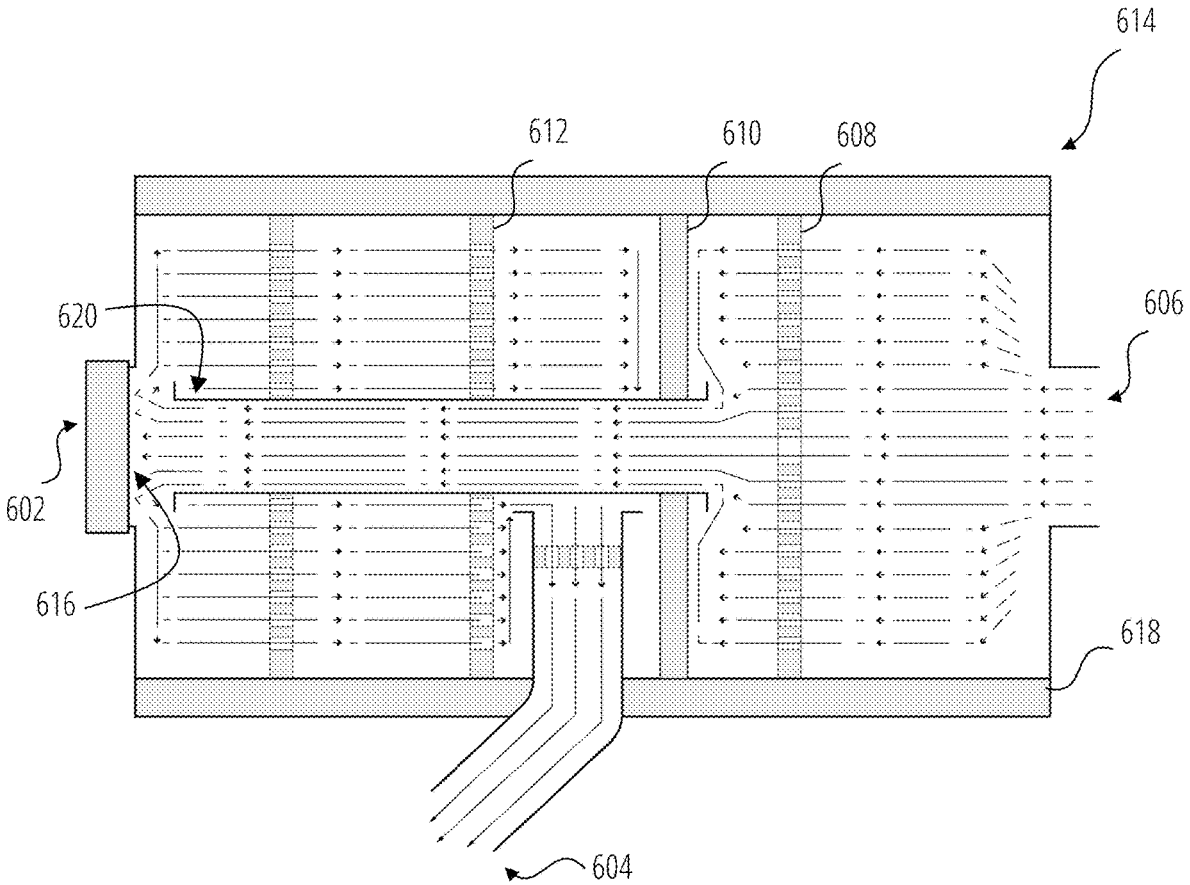
FIG. 6 is a cross-sectional side view of the muffler, wherein the dual function exhaust system attachment is in the quiet configuration.

FIG. 6 is a cross-sectional side view of the muffler 614, wherein the dual function exhaust system attachment is in the quiet configuration. In particular, FIG. 6 is an illustration of the exhaust gas flow from the inlet 606 to the secondary outlet 604 when the primary outlet 616 is concealed with the silencing cap 602. To enable different configurations, the muffler 614 further comprises a primary perforated barrier 608, at least one solid barrier 610, at least one secondary perforated barrier 612, an insulation layer 618, and a pipe section 620.

In reference to FIG. 2, the primary perforated barrier 218 is positioned adjacent the inlet 214 and the at least one secondary perforated barrier 222 is positioned adjacent the primary outlet 212. The at least one solid barrier 220 is positioned in between the primary perforated barrier 218 and the at least one secondary perforated barrier 222 such that the primary perforated barrier 218, the at least one solid barrier 220, and the at least one secondary perforated barrier 222 and 224 are positioned adjacent and in parallel to each other. In a preferred embodiment, the at least one solid barrier 220, the at least one secondary perforated barrier 222, and the at least one secondary perforated barrier 224 are equidistantly positioned to each other. However, in other embodiments of the present disclosure, the spacing between the primary perforated barrier 218, the at least one solid barrier 220, and the at least one secondary perforated barrier 222 may be varied to adjust the overall sound emitted in the quiet configuration and the loud configuration. In a preferred embodiment, a perforation diameter 230 of the primary perforated barrier 218 is greater than a perforation diameter 228 of the at least one secondary perforated barrier 222.

As seen in FIG. 2, the insulation layer 210 is layered along an inner surface 208 of the hollow structural body 206. The pipe section 226, which is concentrically aligned with the primary outlet 212, traverses through the at least one solid barrier 220 and the at least one secondary perforated barrier 222. The pipe section 226 is in fluid communication with the primary outlet 212 to guide the exhaust gas to the primary outlet 212.

In further reference to FIG. 2, the secondary outlet 216 comprises first end 232 and a second end 234, wherein the first end 232 is positioned in between the at least one solid barrier 220 and the at least one secondary perforated barrier 222 in a preferred embodiment. To further mitigate the sound emitted from the muffler 202, a set of perforations 236 is distributed adjacent the first end 232. In a preferred embodiment, a distance from the first end 232 to the second end 234 is selected such that the second end 234 is positioned adjacent the lateral surface 204. Hence, an outermost end of the primary outlet 212 is offset from an outermost point of the secondary outlet 216.

Further referring to FIG. 2, in a different embodiment of the present disclosure, the dual function exhaust system attachment may comprise an outlet-extending pipe section 238 that is removably attached to the second end 234 to alter a gas exit point of the secondary outlet 216. Therefore, in a different embodiment of the present disclosure, an outermost end of the primary outlet 212 may be positioned adjacent an outermost end of the secondary outlet 216.

Referring to FIG. 6, the primary perforated barrier 608, the at least one solid barrier 610, and the at least one secondary perforated barrier 612 are used to alter the exhaust noise from the motor vehicle and reduce backpressure, wherein backpressure is the exhaust gas pressure produced by the engine to overcome the hydraulic resistance of the exhaust system. The insulation layer 618 is used to mitigate heat transfer to surrounding components of the muffler 614 and improve efficiency in the combustion cycle such that the exhaust gas exits at a higher rate. Additionally, the insulation layer 618 may also lower output emissions by raising exhaust temperatures. In a different aspect, by maintaining a stable temperature during operation, the insulation layer 618 may improve the reliability of components surrounding the muffler 614.

Figure 11:
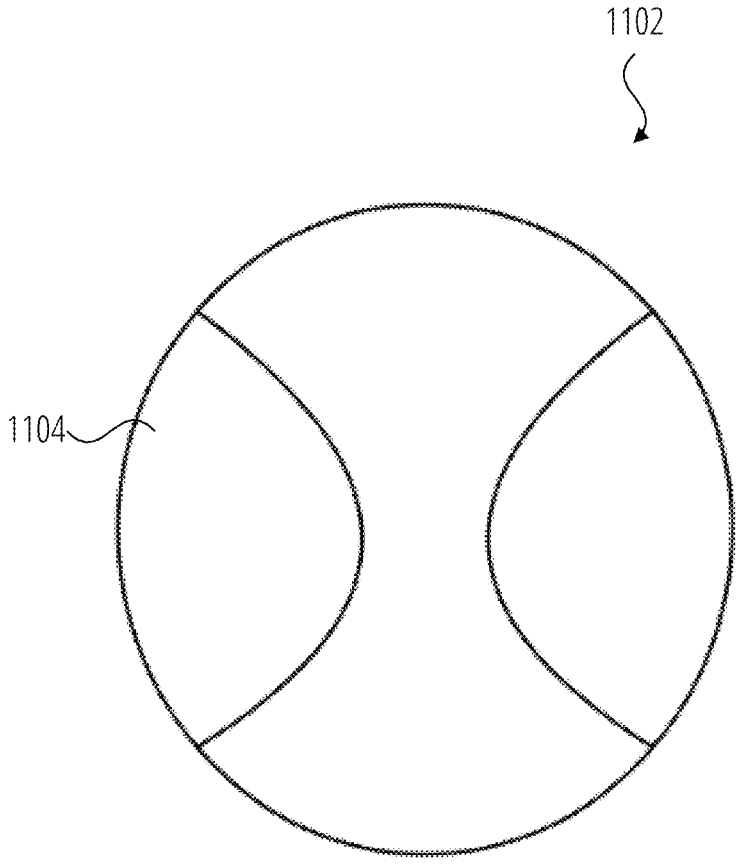
FIG. 11 is a top view of the silencing cap, wherein the outer surface is shaped to form a knob.

In a preferred embodiment, referring to FIG. 3, an outer surface 306 of the silencing cap 302 may form a knob to allow the user to maintain a secure grip on the silencing cap 302 when the silencing cap 302 is removably attached to the primary outlet 616 as seen in FIG. 6. For example, the outer surface 306 may be shaped as a star knob or a 3-point knob in embodiments of the present disclosure. FIG. 11 is another illustration of the silencing cap 1102 where the outer surface 1104 is designed to receive and position the fingers of the user for gripping and rotating purposes.

Figure 7:
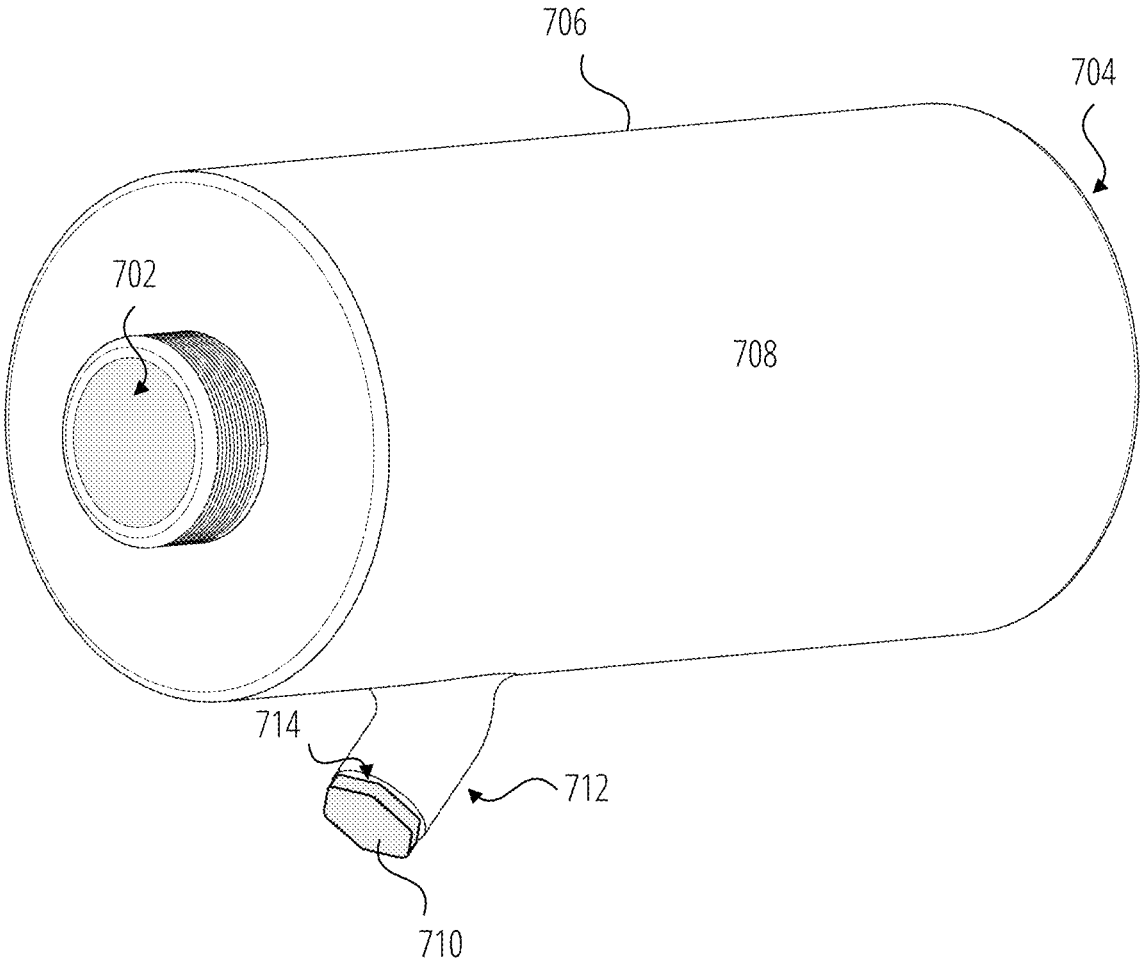
FIG. 7 is a perspective view of the muffler, wherein the dual function exhaust system attachment is in a loud configuration with the sound-enhancing plug mounted to conceal the secondary outlet.

FIG. 7 is a perspective view of dual function exhaust system of the present disclosure in the loud configuration. As seen in FIG. 7, the sound-enhancing plug 710 conceals the secondary outlet 712 such that the exhaust gas exits only through the primary outlet 702.

As seen in FIG. 7, the sound-enhancing plug 710 is detachably mounted to the secondary outlet 712 via a second attachment mechanism 714. In a preferred embodiment, the second attachment mechanism 714, seen in FIG. 7, comprises a second set of external threads 404, seen in FIG. 4, and a second set of internal threads 120 shown in FIG. 1. As seen in FIG. 1, the second set of internal threads 120 is distributed along an internal inner surface 124 adjacent the second end 122 of the secondary outlet 110. As seen in FIG. 4, the second set of external threads 404 is distributed along an outer surface 406 of the sound-enhancing plug 402.

When the dual function exhaust system attachment of the present disclosure is in the loud configuration, the second set of external threads 404 shown in FIG. 4 is threadedly engaged with the second set of internal threads 120 of FIG. 1 to detachably mount the sound-enhancing plug 402 of FIG. 4 to conceal the secondary outlet 110 of FIG. 1. To maintain a tight seal between the sound-enhancing plug 402 of FIG. 4 and the secondary outlet 216 of FIG. 2, an inner diameter 242 seen in FIG. 2 equals an outer diameter 408 seen in FIG. 4.

Even though the sound-enhancing plug 402 of FIG. 4 is threadedly engaged to the secondary outlet 110 of FIG. 1 in a preferred embodiment, other attachment mechanisms may be used in embodiments of the present disclosure. For example, the sound-enhancing plug 402 of FIG. 4 may be detachably mounted to the secondary outlet 110 of FIG. 1 via a flush mount pop-up mechanism. In a different embodiment, the sound-enhancing plug 402 of FIG. 4 may be attached to the secondary outlet 110 of FIG. 1 using a tool that can be, but is not limited to, a hex key. In another embodiment, the sound-enhancing plug 402 can be attached to the secondary outlet 110 via an attachment mechanism that can be, but is not limited to, magnetic coupling, a trap door attachment mechanism, sliding lock latch mechanism, or a turn lock mechanism.

Figure 8:
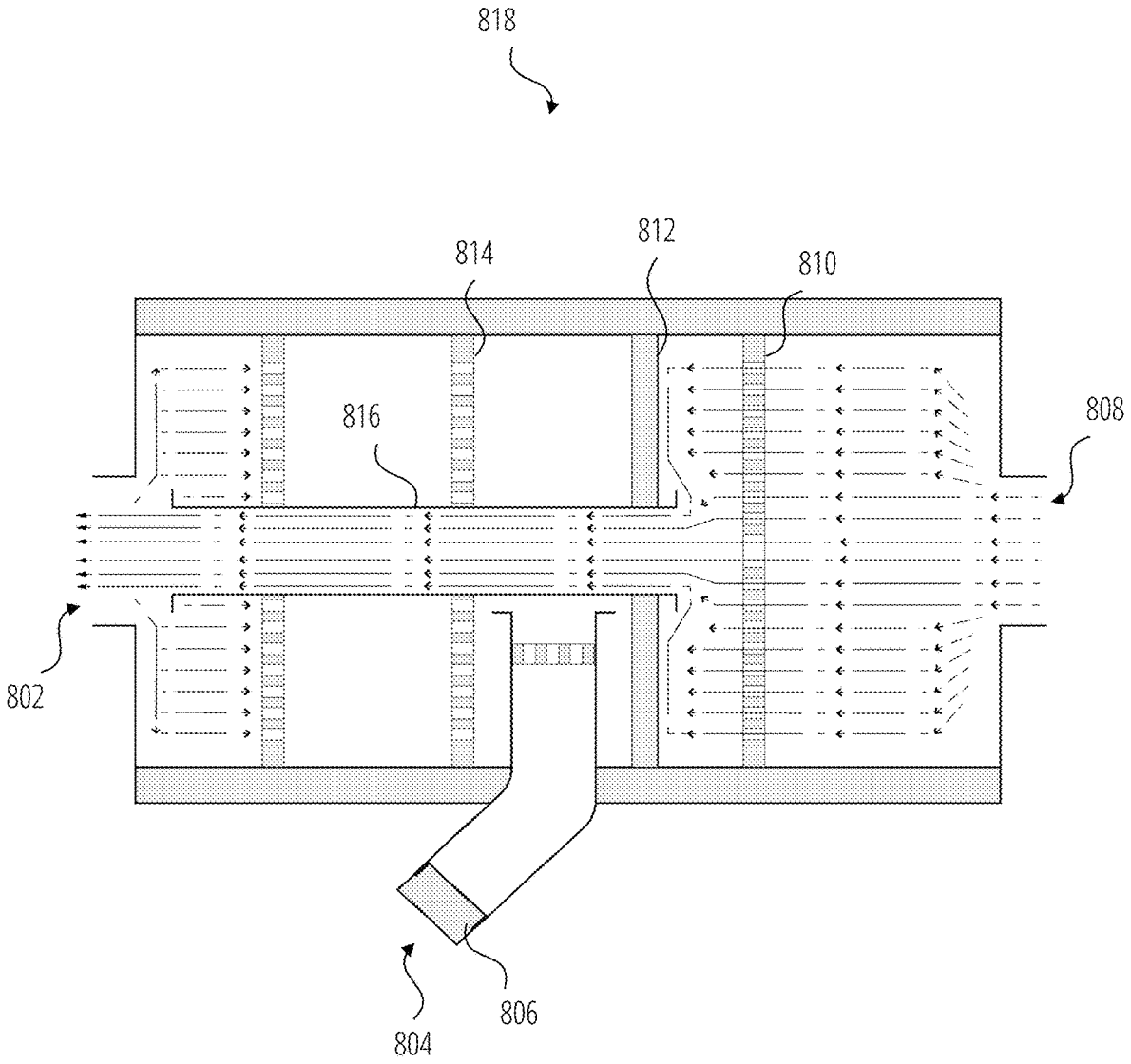
FIG. 8 is a cross-sectional side view of the muffler, wherein the dual function exhaust system attachment is in the loud configuration.

FIG. 8 is a cross-sectional side view of the muffler 818, wherein the dual function exhaust system attachment of the present disclosure is in the loud configuration. In particular, FIG. 8 illustrates the exhaust gas flow from the inlet 808 to the primary outlet 802 when the secondary outlet 804 is concealed with the sound-enhancing plug 806. As seen in FIG. 8, the pipe section 816 guides the exhaust gas toward the primary outlet 802 to enable the loud configuration.

When the dual function exhaust system attachment of the present disclosure is in use, the following process flow is generally followed. As an initial step, referring to FIG. 2, the inlet 214 of the muffler 202 is connected to an exhaust system of a motor vehicle, which is preferably an ATV. Next, based on user preference, the silencing cap 302 of FIG. 3 or the sound-enhancing plug 402 of FIG. 4 is used.

As shown in FIG. 5, if the user prefers the dual function exhaust system attachment to be in the quiet configuration also referred to as the dad-mode, the silencing cap 502 is used to conceal a primary outlet 108 illustrated in FIG. 1. As seen in FIG. 7, if the user prefers the dual function exhaust system attachment to be in the loud configuration also referred to as the sports-mode, the sound-enhancing plug 710 is used to conceal a secondary outlet 110 illustrated in FIG. 1.

In a different aspect of the sports-mode, the user may prefer to utilize both the primary outlet 108 and the secondary outlet 110 shown in FIG. 1. In such instances, the secondary outlet 110 may guide the exhaust gas towards the primary outlet 108. When not in use, the silencing cap 302 and the sound-enhancing plug 402, shown in FIG. 3 and FIG. 4 respectively, may be detachably mounted to the hollow structural body 104 shown in FIG. 1 in a different embodiment.

For durability and heat handling purposes, the muffler 102 of FIG. 1, the silencing cap 302 of FIG. 3, and the sound-enhancing plug 402 of FIG. 4 are preferably manufactured from stainless steel. However, in other embodiments of the present disclosure, mild steel, aluminized steel or any other comparable material may be used.

The foregoing descriptions of specific embodiments of the present invention have been presented for purposes of illustration and description. They are not intended to be exhaustive or to limit the invention and method of use to the precise forms disclosed. Many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A dual function exhaust system attachment, comprising:

a muffler having a hollow essentially cylindrical structural body and first and second ends, the muffler further comprising:

a primary perforated barrier positioned adjacent the inlet at least one solid barrier;

at least one secondary perforated barrier being positioned adjacent the primary outlet;

an insulation layer layered along an inner surface of the hollow structural body; and a pipe section traversing through the at least one secondary perforated barrier and the at least one solid barrier, the pipe section is concentrically aligned with the primary outlet and the pipe section being in fluid communication with the primary outlet, wherein the primary perforated barrier, the at least one solid barrier, and the at least one secondary perforated barrier are positioned adjacent and in parallel to each other within the hollow structural body;

an inlet at the first end of the structural body;

a primary outlet, having a primary inner diameter, the primary outlet positioned at the second end of the structural body extending outwards from the hollow structural body;

a secondary outlet, having a secondary inner diameter, the secondary outlet extending outwards from the hollow structural body;

a silencing cap that is removably attached to the primary outlet; and a sound-enhancing plug that is detachably mounted onto the secondary outlet, wherein the primary inner diameter of the primary outlet is greater than the secondary inner diameter of the secondary outlet.

2. The dual function exhaust system attachment of claim 1, wherein the secondary outlet extends outward from a lateral surface of the hollow structural body.

3. The dual function exhaust system attachment of claim 1, wherein a perforation diameter of the primary perforated barrier is greater than a perforation diameter of the at least one secondary perforated barrier.

4. The dual function exhaust system attachment of claim 1, wherein the secondary outlet comprises a first end and a second end:

the first end of the secondary outlet being positioned in between the at least one solid barrier and the at least one secondary perforated barrier, wherein a set of perforations is distributed adjacent the first end; and the second end of the secondary outlet being positioned adjacent a lateral surface of the hollow structural body.

5. The dual function exhaust system attachment of claim 1, wherein the dual function exhaust system attachment is in a quiet configuration, wherein the silencing cap is removably attached to the primary outlet with a first attachment mechanism;

the first attachment mechanism comprises a first set of internal threads, wherein the first set of internal threads is distributed along an inner surface of the silencing cap;

the first attachment mechanism comprises a first set of external threads, wherein the first set of external threads is distributed along an outer surface of the primary outlet; and the first set of internal threads being threadedly engaged to the first set of external threads.

6. The dual function exhaust system attachment of claim 5, wherein an outer surface of the silencing cap forms a knob.

7. The dual function exhaust system attachment of claim 1, wherein an outermost end of the primary outlet is positioned adjacent an outermost end of the secondary outlet.

8. The dual function exhaust system attachment of claim 1, wherein an outermost end of the primary outlet is offset from an outermost end of the secondary outlet along a length of the muffler body.

9. The dual function exhaust system attachment of claim 8 further comprising:

an outlet-extending pipe section; and the outlet-extending pipe section being removably attached to a second end of the secondary outlet.

10. The dual function exhaust system attachment of claim 1, wherein the silencing cap is manufactured from stainless steel.

11. The dual function exhaust system attachment of claim 1, wherein the sound-enhancing plug is manufactured from stainless steel.

12. The dual function exhaust system attachment of claim 1, wherein the inlet is terminally connected to an all-terrain vehicle (ATV).

13. The dual function exhaust system attachment of claim 1, wherein the inlet is terminally connected to a utility terrain vehicle (UTV).

14. The dual function exhaust system attachment of claim 1, wherein the inlet is terminally connected to an off-road bike.

15. The dual function exhaust system attachment of claim 1, wherein an inner diameter of the silencing cap equals an outer diameter of the primary outlet.

16. The dual function exhaust system attachment of claim 1, wherein an inner diameter of the secondary outlet equals an outer diameter of the sound-enhancing plug.

17. The dual function exhaust system attachment of claim 1, wherein the silencing cap and the sound-enhancing plug are detachably mounted to the hollow structural body.

18. A dual function exhaust system attachment comprising:

a muffler having a hollow essentially cylindrical structural body and first and second ends, an inlet at the first end of the structural body;

a primary outlet, having a primary inner diameter, the primary outlet positioned at the second end of the structural body extending outwards from the hollow structural body;

a secondary outlet, having a secondary inner diameter, the secondary outlet extending outwards from the hollow structural body;

a silencing cap that is removably attached to the primary outlet; and a sound-enhancing plug that is detachably mounted onto the secondary outlet, wherein the primary inner diameter of the primary outlet is greater than the secondary inner diameter of the secondary outlet;

the dual function exhaust system attachment is in a loud configuration, wherein the sound-enhancing plug is detachably mounted onto the secondary outlet with a second attachment mechanism;

the second attachment mechanism comprises a second set of internal threads, wherein the second set of internal threads is distributed along an inner surface adjacent a second end of the secondary outlet;

the second attachment mechanism is a flush mount pop-up attachment mechanism comprising a second set of external threads, wherein the second set of external threads is distributed along an outer surface of the sound-enhancing plug; and the second set of internal threads being threadedly engaged to the second set of external threads.

* * * * *